US005709464A

United States Patent [19]

Tseng

[11] Patent Number: 5,709,464

[45] Date of Patent: Jan. 20, 1998

[54] VIBRATING SWITCH CONTROLLED FLASHING LIGHT CIRCUIT STRUCTURE

[76] Inventor: Shen-Ko Tseng, No. 28, Lane 41, Chyau-Dong St., Shih-Chih Jenn, Taipei Hsien, Taiwan

[21] Appl. No.: 715,882

[22] Filed: Sep. 19, 1996

[51] Int. Cl.[6] ..... F21V 33/00; F21L 15/08

[52] U.S. Cl. ..... 362/276; 362/103; 362/802; 36/137

[58] Field of Search ..... 362/104, 105, 362/103, 106, 800, 802, 806, 276; 36/137, 136, 139

[56] References Cited

U.S. PATENT DOCUMENTS

| | | | |
|---|---|---|---|
| 5,375,044 | 12/1994 | Guritz | 362/800 |
| 5,381,615 | 1/1995 | MacMillan | 362/103 |
| 5,396,720 | 3/1995 | Hwang | 362/276 |
| 5,485,358 | 1/1996 | Chien | 362/103 |
| 5,490,338 | 2/1996 | Hwang | 362/103 |
| 5,523,927 | 6/1996 | Gokey | 362/103 |

*Primary Examiner*—James C. Yeung
*Attorney, Agent, or Firm*—Pro-Techtor International

[57] ABSTRACT

A vibrating switch controlled flashing light circuit includes a vibrating switch, a battery, an integrated circuit mounted on a substrate, a plurality of lead wires and light emitting diodes, and a housing. When subjected to external forces, the circuit will be connected to cause the LEDs to generate cyclical flashes and stop flashing after a set period. After a delay of several seconds, one of the LEDs alone will flash for several seconds and stop. During the period of flashing, the circuit may refuse other actuation signals or accept them to start a new flashing period. The circuit structure may be adapted for use on clothing, luggage, rucksacks, sports shoes and equipment, etc., for purposes of identification and ensuring safety at night.

1 Claim, 5 Drawing Sheets

VIBRATING SWITCH CONTROLLED FLASHING LIGHT CIRCUIT STRUCTURE

BACKGROUND OF THE INVENTION (a) Field of the Invention

The present invention relates generally to a vibrating switch controlled flashing light circuit structure, and more particularly to a flashing light circuit structure including a vibrating switch, a battery, an integrated circuit, a substrate, lead wires and a housing, which may be used on clothing, purses, or sports equipment for identification purposes.

(b) Description of the Prior Art

Poor illumination at night is a set back to night activities. There may be problems of difficult identification and safety. People jogging or cycling at night may be hit by cars due to insufficient illumination. Playing balls in open places may have to be stopped at night if the street lights are not strong enough. It is therefore necessary to find means to enhance the safety and smooth-going of night activities.

There is available on the market a kind of flashing sports shoes. It utilizes LED bulbs and battery to generate a spot of light or uses circuit control to generate a flashing spot of light at the heels of the shoes. However, as such light generating devices are small and the flashing effects are poor, they cannot solve the problem.

SUMMARY OF THE INVENTION

A primary object of the present invention is to provide a vibrating switch controlled flashing light circuit structure comprising a vibrating switch, a battery, an integrated circuit and a plurality of LEDs, which is compactly designed and may be adapted to adhere to or couple to various articles and objects to generate large area and eye-catching flashing effects at very little electric energy consumption.

Another object of the present invention is to provide a serial LEDs flashing light circuit in which the LEDs may be distributed on the surfaces of various articles and objects to generate flashes at night so that the flashing light may be clearly seen from various angles.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
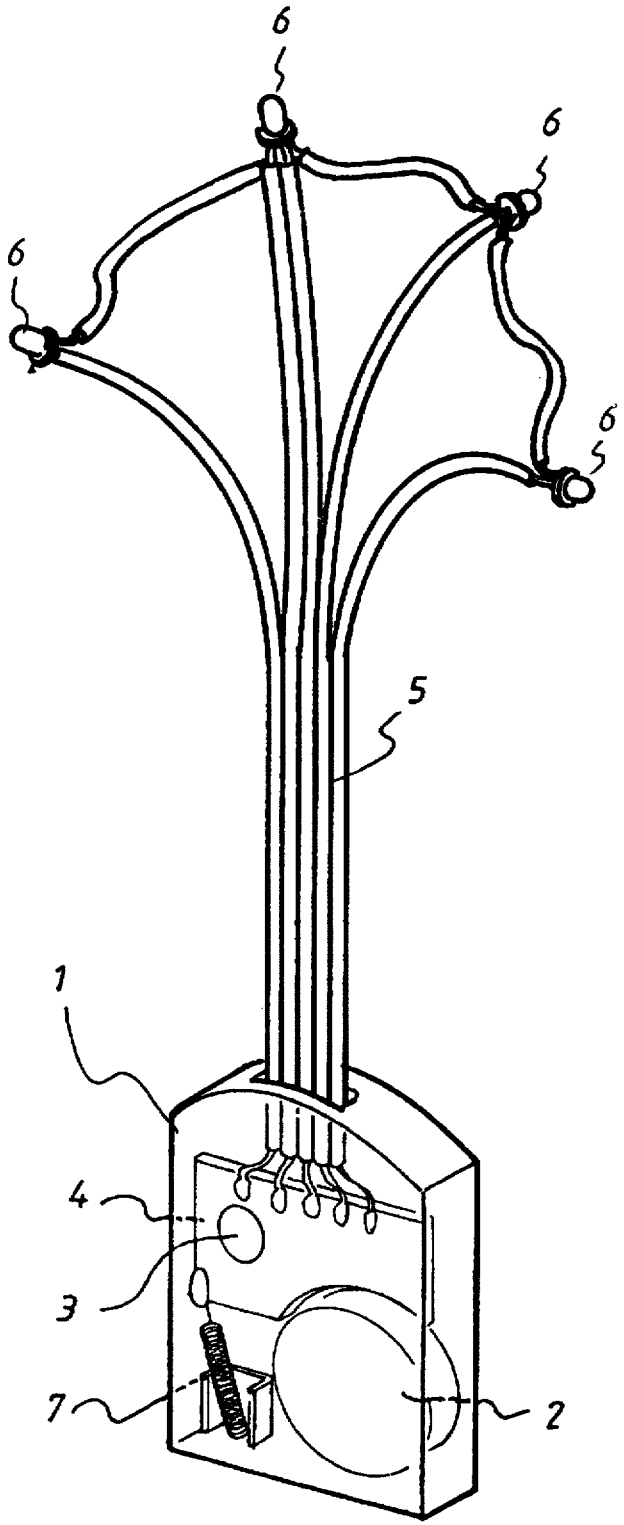
FIG. 1 is an elevational view of the present invention.
Figure 2:
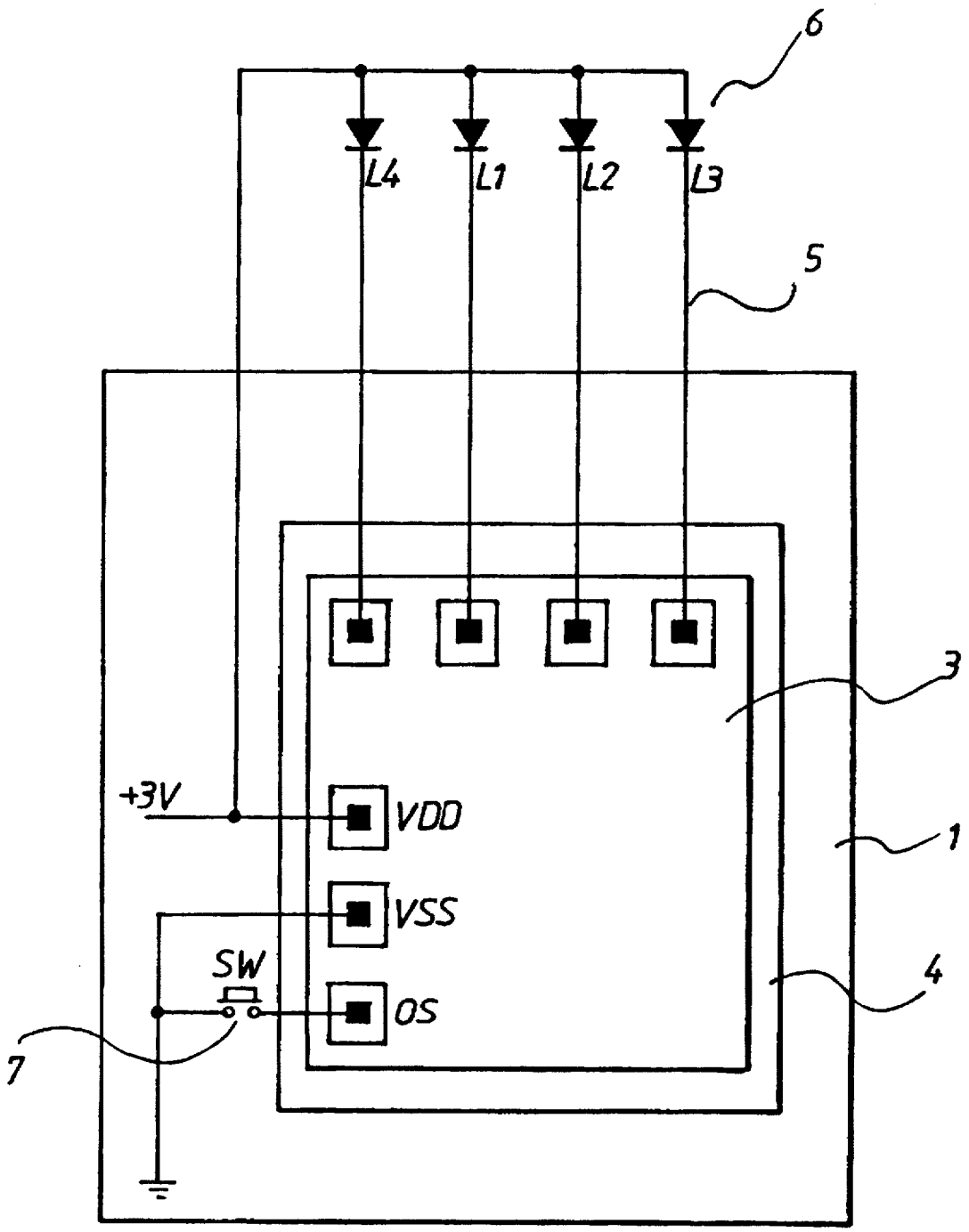
FIG. 2 is illustrates the arrangement of the circuit according to the present invention.

With reference to FIG. 1, the present invention essentially comprises a housing 1, a battery 2, an integrated circuit 3, a substrate 4, a plurality of lead wires 5, a plurality of LEDs 6 and a vibrating switch 7. Referring to FIG. 2, the housing 1 accommodates the battery 2 (a mercury battery cell supplying +3V power) and the substrate 4, which is basically coupled (by wiring) to the integrated circuit 3. The integrated circuit 3 provides a cyclic flashing control after actuation. The lead wires 5 are connected to the substrate 4 and led out of the housing 1. The ends of the lead wires 5 are each coupled to an LED in a series manner. The switch 7 provides a one shot type control. Its structure may be formed by an electrically conductive material. A micro-distance is maintained between a spring and a securing piece of the switch 7. When the housing 1 is subjected to an external force and vibrates, a minute displacement of the spring will cause it to come into contact with the securing piece, actuating the integrated circuit 3, and this is the so-called one shot type actuation. Upon actuation, the LEDs 6, i.e., L1–L4 will cyclically flash in sequence. After the set period is completed, there is a brief delay, and one of the LEDs (for instance, L4) will flash for several seconds before it stops. For this type of flashing, two modes may be set. In one of them, when the LEDs 6 are in the flashing period, they do not accept the control of the switch 7 and will only accept another actuation after a flashing period is completed. In the other mode, during the flashing period of the LEDs (L1–L4), they may continue to be actuated by the switch 7, and will start a new flashing period by interrupted the previous one. Depending on the type of objects or articles the invention is used on, these two modes may be selectively adopted.

Referring to FIG. 2 illustrating the arrangement of the integrated circuit 3, the design and features of the circuit are summarized hereinbelow. VDD refers to the positive pole, VSS the negative pole, OS one shot button, TEST internal testing, and L1–L4 outputs of lead wires. The working voltage is within the range of 1.35–5.0V DC. Minimum output electric current is 30 mA, voltage 3V, static electricity below 1 uA. The flashing operation of the LEDs 6 is described below: 1. When the switch is actuated, the integrated circuit 3 causes L1→L2→L3 to flash in sequence for several turns and then stop. After several seconds of delay, L4 alone flashes for several seconds and then automatically stops. 2. After actuation, L1→L2→L3→L4 flash in sequence for a period and then automatically stop. 3. If the switch is actuated continuously, L1→L2→L3→L4 flash in sequence for a period and then automatically stop. 4. After actuation, L1→L2→L3 flash in sequence for several turns. At this time, they do not accept any actuation signals. 5. After actuation, L1→L2→L3 flash in sequence for several turns. When re-actuated (open to actuation signals) flashing will start all over again from the initial position, followed the operations in Item 4. →Item 2. In addition to the above, the output ends may also be coupled to several LEDs in series.

Since LEDs are provided to generate cyclical flashing and the lead wires may be extended to couple to more LEDs in series, the present invention may be adapted for use in various articles so that LEDs may be arranged thereon to perform cyclic flashing. Hence, not only the flashing area may be increased, electric power may also be saved. A mercury battery cell may then last for a very long time and may not need replacement throughout the life of circuit structure of the present invention.

Figure 3:
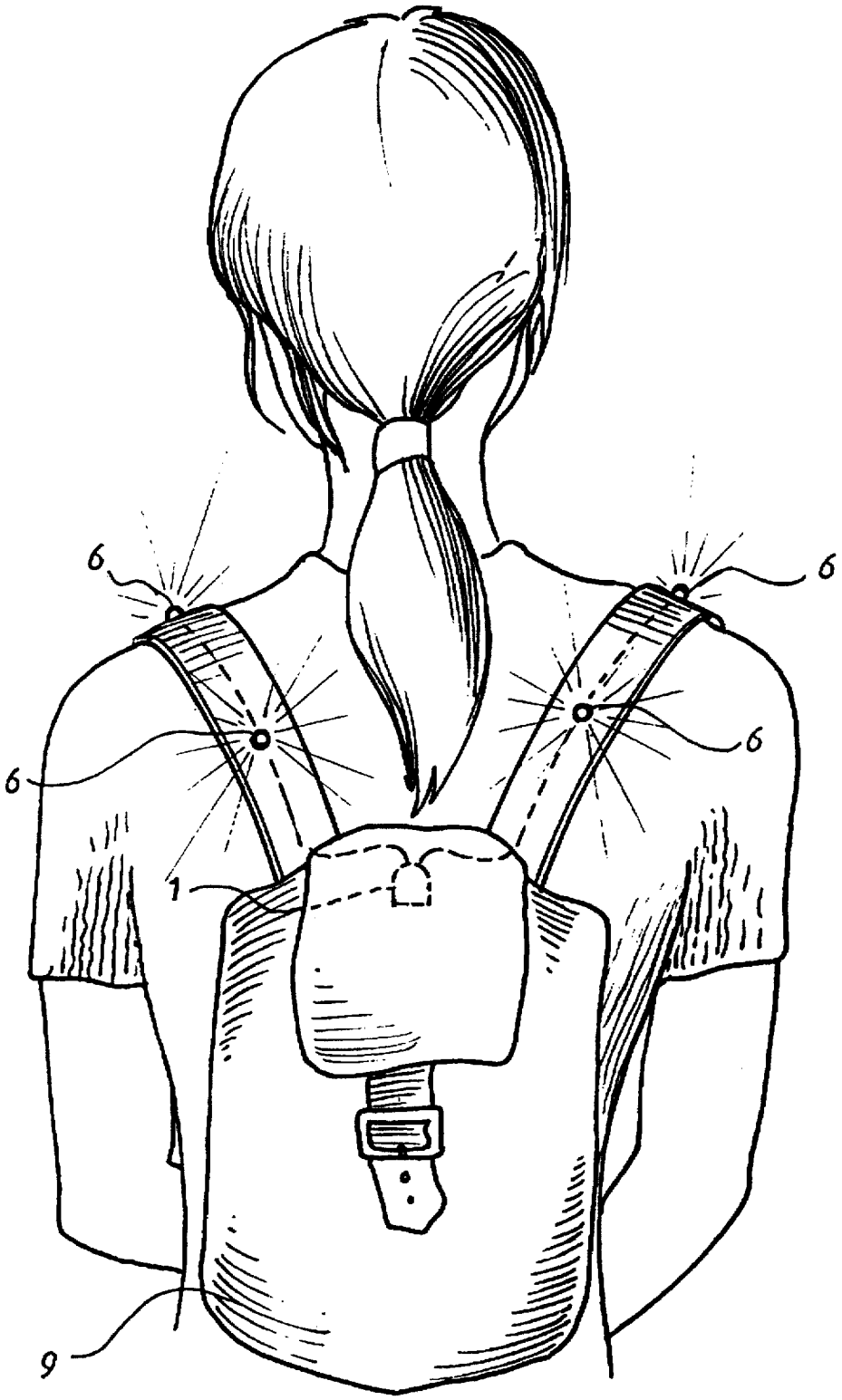
FIG. 3 illustrates a first embodiment of the present invention.

Referring to FIG. 3, the present invention may be disposed on the surface of handbags or rucksacks 9 such that the LEDs are distributed on the surface of the handbags or rucksacks 9. When the wearer walks, the vibration thus generated will keep on actuating the switch 7 to generate cyclical flashing effects. When used at night, the present invention may thus provide a good identification to enhance safety.

Figure 4:
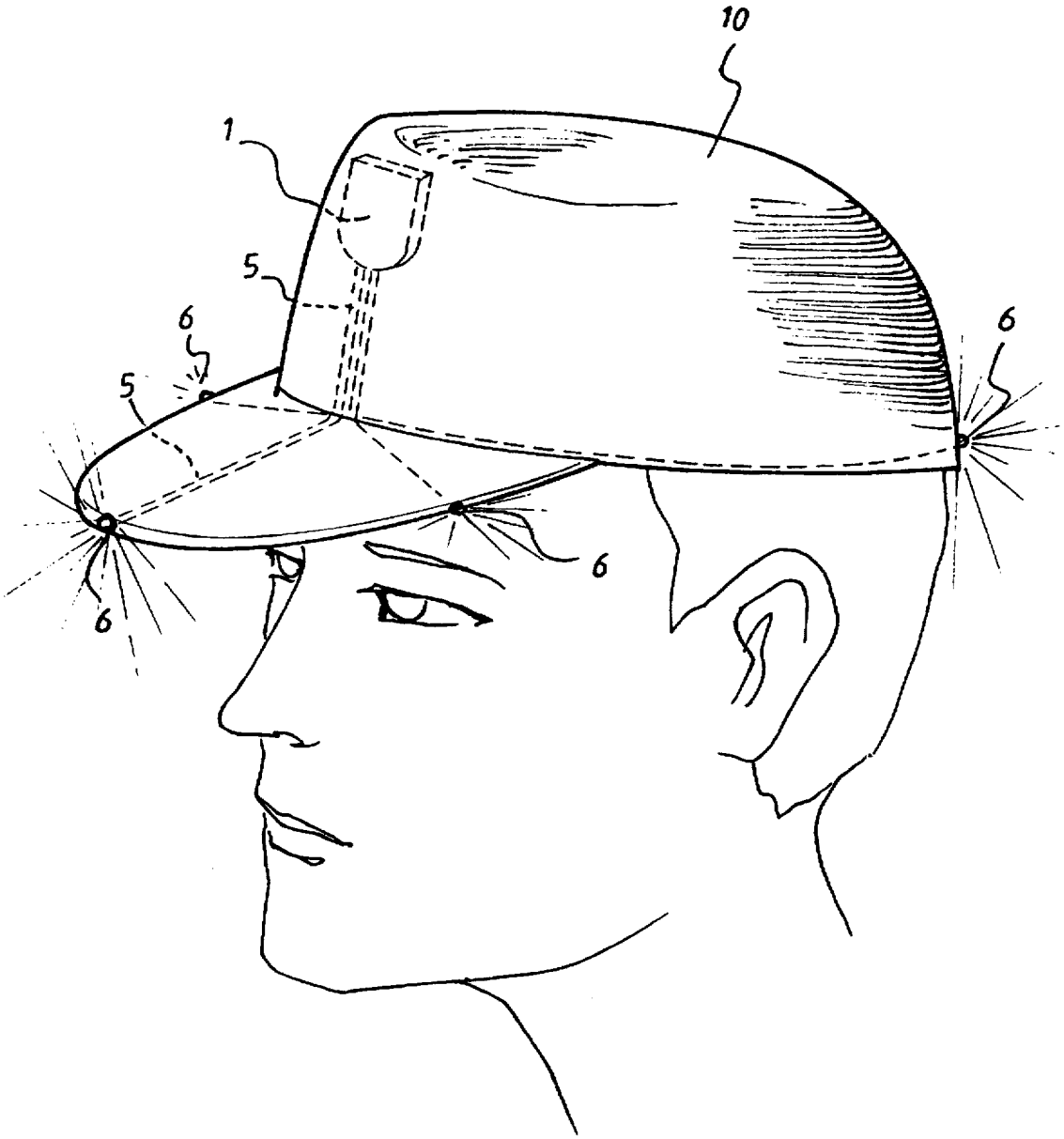
FIG. 4 illustrates a second embodiment of the present invention.

As shown in FIG. 4, the present invention may be used on a cap 10. The housing I may be concealed below the visor or inside the cap with the LEDs 6 distributed on the visor rim or the back of the cap. When the wearer walks or runs, the vibration thus generated will actuate the LEDs to flash cyclically.

Figure 5:
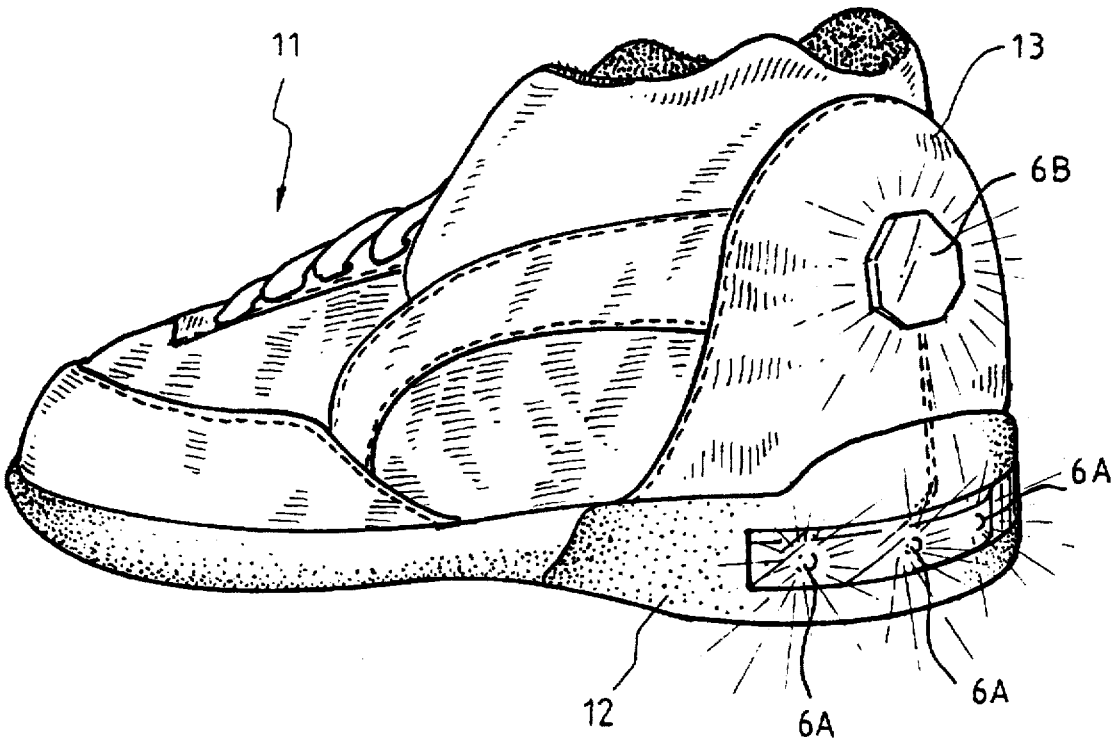
FIG. 5 illustrates a third embodiment of the present invention.

In the embodiment shown in FIG. 5, the present invention is used in a sports shoe 11. A plurality of LEDs 6A are disposed in a heel portion 12 of the sole. Another LED 6B may be disposed at the middle of a back portion 13 of the shoe 11. When the wearer walks or runs, the LEDs 6A will keep on flashing due to continuous actuation. Once the wearer stops, the LED 6B will flash. In such a design, the LED 6A is preferably green (representing "pass") while the LED 6B is preferably red (representing "stop").

In summary, the present invention is compact, energy saving, and may be adapted for use in many different objects and articles to provide larger area of cyclical flashing and continuous flashing.

Although the present invention has been illustrated and described with reference to the preferred embodiment thereof, it should be understood that it is in no way limited to the details of such embodiment but is capable of numerous modifications within the scope of the appended claims.

What is claimed is:

1. A vibrating switch controlled flashing light circuit structure, comprising:

a sensitive vibrating switch for actuating a plurality of light emitting diodes controlled by an integrated circuit so that said light emitting diodes flash cyclically, at least one of said light emitting diodes being red, and at least two of said light emitting diodes being green, wherein a housing accommodates a battery, a substrate, and a vibrating contact controlled switch, said integrated circuit being disposed on said substrate and having a one-shot actuation button and a sequential cyclical flashing circuit, said integrated circuit further having a plurality of outputs connected to a plurality of lead wires via said substrate, said lead wires extending outside of said housing, said light emitting diodes being coupled to the respective ends of said lead wires, such that when said switch is actuated, said green light emitting diodes flash in sequence for several cycles and then, after a brief delay, said red light emitting diode will start flashing.

* * * * *